US009411317B2

(12) United States Patent
Momose

(10) Patent No.: US 9,411,317 B2
(45) Date of Patent: Aug. 9, 2016

(54) TIMEPIECE

(71) Applicant: SEIKO EPSON CORPORATION, Tokyo (JP)

(72) Inventor: Tomonori Momose, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/870,758

(22) Filed: Sep. 30, 2015

(65) Prior Publication Data

US 2016/0179055 A1 Jun. 23, 2016

(30) Foreign Application Priority Data

Dec. 17, 2014 (JP) ..... 2014-255170

(51) Int. Cl.
*G04B 37/04* (2006.01)

(52) U.S. Cl.
CPC ..... *G04B 37/04* (2013.01); *G04B 37/0418* (2013.01)

(58) Field of Classification Search
CPC ..... G04G 37/0008; G04G 37/04; G04G 37/0418; G04G 37/0427; G04G 37/0472; G04G 37/05; G04G 37/052
See application file for complete search history.

(56) References Cited

U.S. PATENT DOCUMENTS 3,492,810 A * 2/1970 Levrat ..... G04B 37/04 368/287
3,735,584 A * 5/1973 Tokunaga ..... G04B 37/052 368/287
3,855,786 A * 12/1974 Yamamoto ..... G04B 37/052 368/287
6,406,178 B1 * 6/2002 Luscher ..... G04B 37/0008 368/286
6,762,976 B1 * 7/2004 Tamaru ..... G04B 37/005 368/281
8,636,404 B2 * 1/2014 Hiranuma ..... G03F 7/029 368/287
8,708,552 B2 * 4/2014 Ueno ..... G04G 17/04 368/276

FOREIGN PATENT DOCUMENTS

JP 2001-013268 A 1/2001

* cited by examiner

*Primary Examiner* — Vit W Miska
(74) *Attorney, Agent, or Firm* — Global IP Counselors, LLP

(57) ABSTRACT

A timepiece includes an exterior case having a protruding section, a case back, a dial receiving ring, a dial, a dial ring, and a casing ring disposed around the outer circumference of the dial receiving ring. The casing ring includes a casing-ring-side contact section that comes into contact with the inner circumferential surface of the exterior case, a front-surface-side contact section that comes into contact with the protruding section, a casing ring spring section that is formed to be elastically deformable in the thickness direction of the timepiece and comes into contact with the case back, and a support section that protrudes from the inner circumferential surface of the casing ring.

5 Claims, 6 Drawing Sheets

TIMEPIECE

BACKGROUND

1. Technical Field

The present invention relates to a timepiece.

2. Related Art

Wristwatches are so designed that a common movement, which is a basic component, is incorporated in a timepiece case that varies in terms of size and exterior appearance by using a casing ring for both cost reduction and an increase in exterior appearance variation, whereby a plurality of kinds of timepiece having different sizes and exterior appearances are configured (see JP-A-2001-13268, for example).

In JP-A-2001-13268, the casing ring (support member) is positioned in the in-plane direction by allowing protrusions formed at a plurality of locations along the outer circumferential surface of the casing ring to come into contact with the inner circumferential surface of an exterior case.

On the other hand, the casing ring is positioned in the thickness direction (height direction) of the timepiece by pressing the front surface of the periphery of a dial against the exterior case via a receiving ring (dial receiving member) supported by the casing ring. That is, the dial, the receiving ring, and the casing ring are sequentially disposed between the exterior case and the case back in the direction from the front side to the rear side of the timepiece, and push-up protrusions of the case back press the casing ring toward the front side of the timepiece for the positioning in the height direction.

In JP-A-2001-13268 described above, the front surface of the casing ring is not in direct contact with the case, but the lifted casing ring is positioned in the height direction by causing the dial to come into contact with the case via the receiving ring. In this configuration, if the dimensions of the dial, the receiving ring, and the casing ring are not precise enough and have errors, the positions of the casing ring and the receiving ring in the height direction are affected by an accumulated value of the errors. The height position of the movement held by the receiving ring could therefore undesirably vary.

SUMMARY

An advantage of some aspects of the invention is to provide a timepiece that allows a plurality of kinds of timepiece having different case sizes to be configured at low cost and a movement to be positioned with improved precision.

A timepiece according to an aspect of the invention includes a case that accommodates a movement and has a protruding section that protrudes from an inner circumferential surface of the case, a case back attached to the case, a dial receiving ring attached to the movement, a dial disposed on a front surface side of the dial receiving ring, a restriction section that comes into contact with a front surface of the dial to restrict a position of the dial, and a casing ring disposed around an outer circumference of the dial receiving ring. The casing ring includes a casing-ring-side contact section that comes into contact with the inner circumferential surface of the case to position the casing ring in an in-plane direction, a front-surface-side contact section that comes into contact with the protruding section of the case to position the casing ring in a timepiece front surface direction, a casing ring spring section that is formed to be elastically deformable in a thickness direction of the timepiece and comes into contact with the case back, and a support section that protrudes from an inner circumferential surface of the casing ring. The dial receiving ring includes a ring-side contact section that comes into contact with the inner circumferential surface of the casing ring to position the dial receiving ring in the in-plane direction, a ring front-surface-side contact section that comes into contact with a rear surface of the dial, and a ring spring section that is formed to be elastically deformable in the thickness direction of the timepiece and comes into contact with the support section of the casing ring.

In the aspect of the invention, the dial, the movement, the dial receiving ring, and the casing ring are accommodated in the case, and the case back is attached to the case. The timepiece is thus assembled. In this process, the casing ring spring section of the casing ring comes into contact with the case back and the casing ring spring section is then elastically deformed, so that the casing ring is pushed up toward the front surface side of the timepiece, and the front-surface-side contact section of the casing ring comes into contact with the protruding section of the case. That is, the casing ring is sandwiched between the case and the case back, and spring force resulting from the elastic deformation of the casing ring spring section presses the casing ring toward the front surface side of the timepiece. As a result, the height position of the casing ring is precisely set in a position where the front-surface-side contact section of the casing ring comes into contact with the protruding section of the case.

Further, the ring spring section comes into contact with the casing ring having been in direct contact with the case and hence positioned in the height direction and the ring spring section is then elastically deformed, so that the dial receiving ring is pushed up toward the front surface side of the timepiece, and the ring front-surface-side contact section comes into contact with the rear surface of the dial. That is, the dial receiving ring is sandwiched between the dial and the casing ring, and spring force resulting from the elastic deformation of the ring spring section presses the dial receiving ring toward the front surface side of the timepiece. It is noted that the height-direction position of the dial, the front surface of which comes into contact with the restriction section, for example, a barrel or a bezel of the case or a dial ring, is precisely set with reference to the case. The height position of the dial receiving ring is therefore also precisely set in a position where the ring front-surface-side contact section comes into contact with the dial. As a result, the height position of the movement held by the dial receiving ring can also be precisely set.

Further, the in-plane position of the movement can be precisely set because the in-plane position is set when the ring-side contact section of the dial receiving ring comes into contact with the inner circumferential surface of the casing ring and the casing-ring-side contact section of the casing ring comes into contact with the inner circumferential surface of the case.

The movement can therefore be positioned with improved precision in the height direction (timepiece thickness direction) and the in-plane direction. Further, when the size of the case is changed, the casing ring only needs to be so changed that the casing-ring-side contact section has a different protruding dimension, whereby the same dial receiving ring and movement can be used as common parts. Therefore, when a plurality of types of timepiece having different case sizes are configured, the common movement and dial receiving ring can be used, whereby the number of types of part can be reduced and cost reduction can therefore be achieved.

In the timepiece according to the aspect of the invention, it is preferable that the ring spring section is formed of a plurality of ring spring sections provided along a circumferential direction of the dial receiving ring.

The plurality of ring spring sections allow the entire dial receiving ring to be urged toward the dial in a stable manner.

In the timepiece according to the aspect of the invention, it is preferable that the ring spring section includes two column sections and a beam section that extends between the column sections, that a hook section that holds the movement is formed on an inner circumferential surface of each of the column sections, and that a push-up protrusion that comes into contact with the support section of the casing ring is formed on a bottom surface of the beam section.

When the structure of the ring spring section is primarily formed of two column sections and a beam section that extends between the column sections, the spring force can be increased as compared, for example, with a case where the beam section is supported as a cantilever. Further, when a push-up protrusion is formed on the bottom surface of the beam section, the amount of deflection of the beam section can be increased and the ring spring section can be simply configured with an increase in the magnitude of the spring force.

Further, the hook section formed on each of the column sections allows the column sections to deflect when the movement is pressed in, whereby the movement can be readily attached.

In the timepiece according to the aspect of the invention, it is preferable that the casing ring spring section is formed of a plurality of casing ring spring sections provided along a circumferential direction of the casing ring.

The plurality of casing ring spring sections allow the entire casing ring to be urged toward the protruding section of the case in a stable manner.

In the timepiece according to the aspect of the invention, it is preferable that the casing ring spring section has two column sections and a beam section that extends between the column sections, and that a push-up protrusion that comes into contact with the case back is formed on a bottom surface of the beam section.

When the structure of the casing ring spring section is primarily formed of two column sections and a beam section that extends between the column sections, the spring force can be increased as compared, for example, with a case where the beam section is supported as a cantilever. Further, when a push-up protrusion is formed on the bottom surface of the beam section, the amount of deflection of the beam section can be increased and the casing ring spring section can be simply configured with an increase in the magnitude of the spring force.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
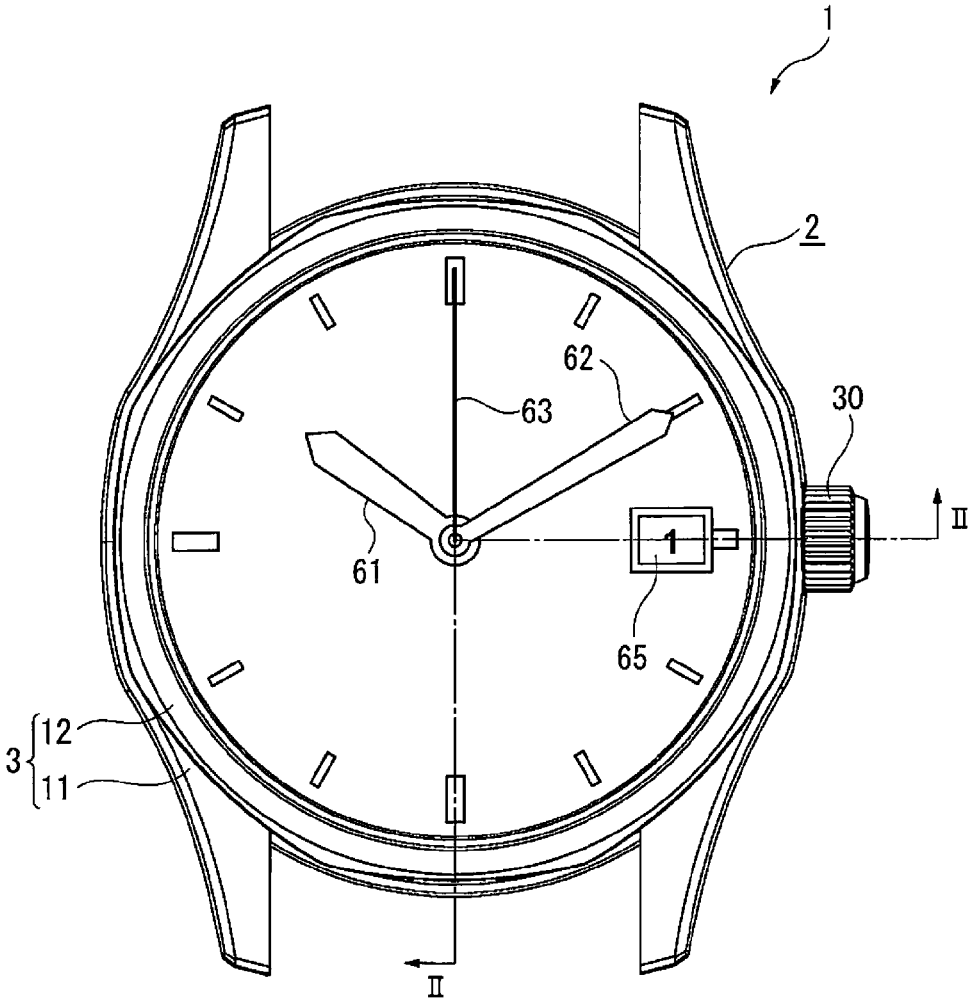
FIG. 1 is a front view showing a timepiece according to an embodiment of the invention.

A timepiece (wristwatch) 1 according to an embodiment of the invention will be described below with reference to FIGS. 1 to 5. FIG. 2 is a cross-sectional view taken along the line II-II in FIG. 1. In FIG. 2, the left half shows a cross section of part of the timepiece, the portion from the six-o'clock position to the shaft of indicating hands, and the right half shows a cross section of part of the timepiece, the portion from the shaft of the indicating hands to the three-o'clock position. In the description of each component of the timepiece 1, the surface of the component on the side facing the front surface of the timepiece 1 (the side facing a cover glass plate 5) is called a front surface or an upper surface, and the surface of the component on the side facing a case back 4 is called a rear surface, a bottom surface, or a lower surface in some cases.

The timepiece 1 includes an exterior case 2, which accommodates a movement, which will be described later, and other components. The exterior case 2 has a case body 3 and the case back 4. The case body 3 has a cylindrical barrel 11 and a bezel 12 provided on the front surface side of the barrel 11.

Figure 2:
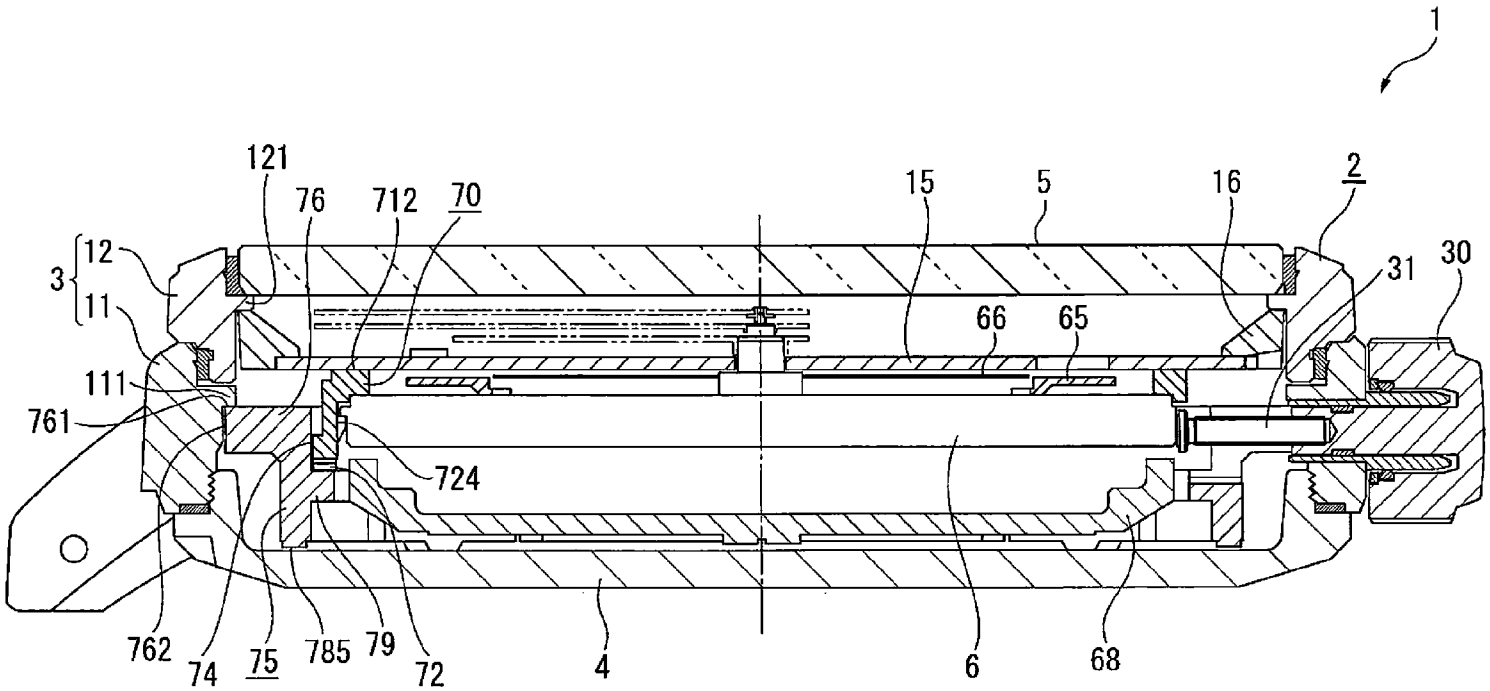
FIG. 2 is a schematic cross-sectional view taken along the line II-II in FIG. 1.
Figure 3:
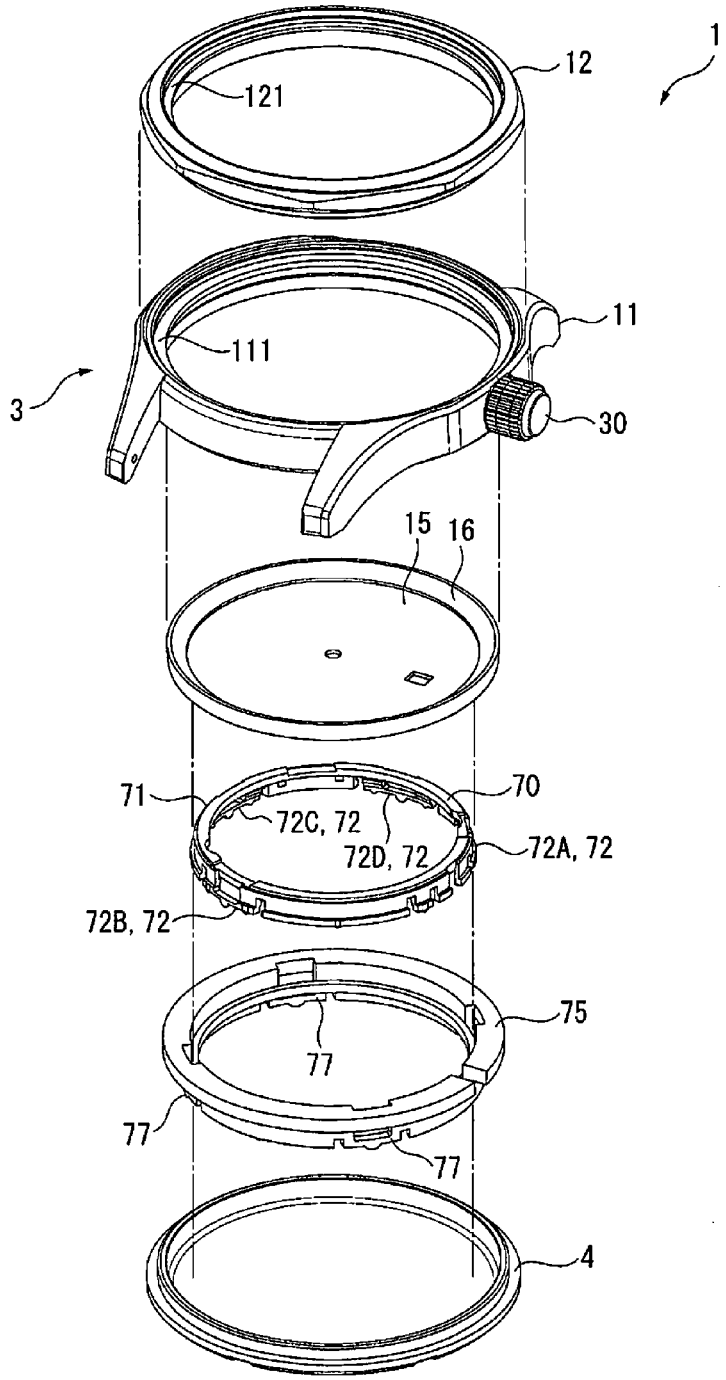
FIG. 3 is an exploded perspective view of key portions of the timepiece.

The barrel 11 is provided with a crown 30. A roughly annular protruding section 111 is formed along the inner circumferential surface of the barrel 11 and continuously extends along the circumferential direction of the inner circumferential surface, as shown in FIGS. 2 and 3.

The bezel 12 is formed in a ring shape. The bezel 12 and the barrel 11 are connected to each other by using a fitting structure in which a protrusion formed on one of surfaces of the bezel and barrel that face each other is fit into a recess formed in the other or by using a double-sided adhesive tape, an adhesive, or any other bonding means. The bezel 12 may be attached to the barrel 11 in a rotatable manner.

The cover glass plate 5, which is held by the bezel 12, is so attached to the bezel 12 that the cover glass plate 5 is located inside the bezel 12. Further, a roughly annular protruding section 121 is formed along the inner circumferential surface of the bezel 12 and continuously extends along the circumferential direction of the inner circumferential surface.

The case back 4, which has a disk shape and closes the rear-surface-side opening of the case body 3, is provided on the rear surface side of the case body 3. The case back 4 is screwed into the barrel 11 of the case body 3.

The barrel 11, the bezel 12 and the case back 4 are made of BS (brass), SUS (stainless steel), a titanium alloy, or any other metal material.

Internal Structure of Timepiece

A description will next be made of an internal structure built in the exterior case 2 of the timepiece 1.

In the exterior case 2 are accommodated a movement 6, a dial 15, a dial ring 16, which is disposed along the outer circumferential edge of the dial 15, a dial receiving ring 70, and a casing ring 75, as shown in FIGS. 2 and 3.

The movement 6 is attached to the inner circumference of the dial receiving ring 70. The dial 15 is in contact with the front surface of the dial receiving ring 70 and so attached that the dial 15 is located on the timepiece front surface side of the movement 6 (the side facing the cover glass plate 5).

Movement

The movement 6 can be a movement having been used in a timepiece of related art. In the present embodiment, the movement 6 includes a power generator that generates electric power by rotation of a rotating weight 68, a secondary battery charged by the electric power generated by the power generator, and a motor driven by the electric power from the secondary battery.

The movement 6 may instead be a movement for a typical quartz timepiece in which a button-shaped primary battery drives a stepper motor or a movement including a power generator that generates electric power by use of a mainspring as a drive source, a secondary battery charged by the electric power generated by the power generator, and a motor driven by the electric power from the secondary battery. The movement 6 may still instead be a movement for a mechanical timepiece in which drive force produced by a mainspring rotates train wheels and a speed controller performs speed control.

The movement 6 in the present embodiment drives an hour hand 61, a minute hand 62, and a second hand 63 shown in FIG. 1 via a stepper motor and train wheels. The movement 6 further drives a date indicator 65 via the stepper motor and the train wheels. A date indicator maintaining plate 66 is disposed on the front surface side of the date indicator 65. The layout, the number, the type, and other attributes of the indicating hands and the date indicator are not limited to those shown in FIG. 1.

Further, a winding stem 31 is disposed in the movement 6, and the crown 30 is attached to an end portion of the winding stem 31.

Dial Receiving Ring

Figure 4:
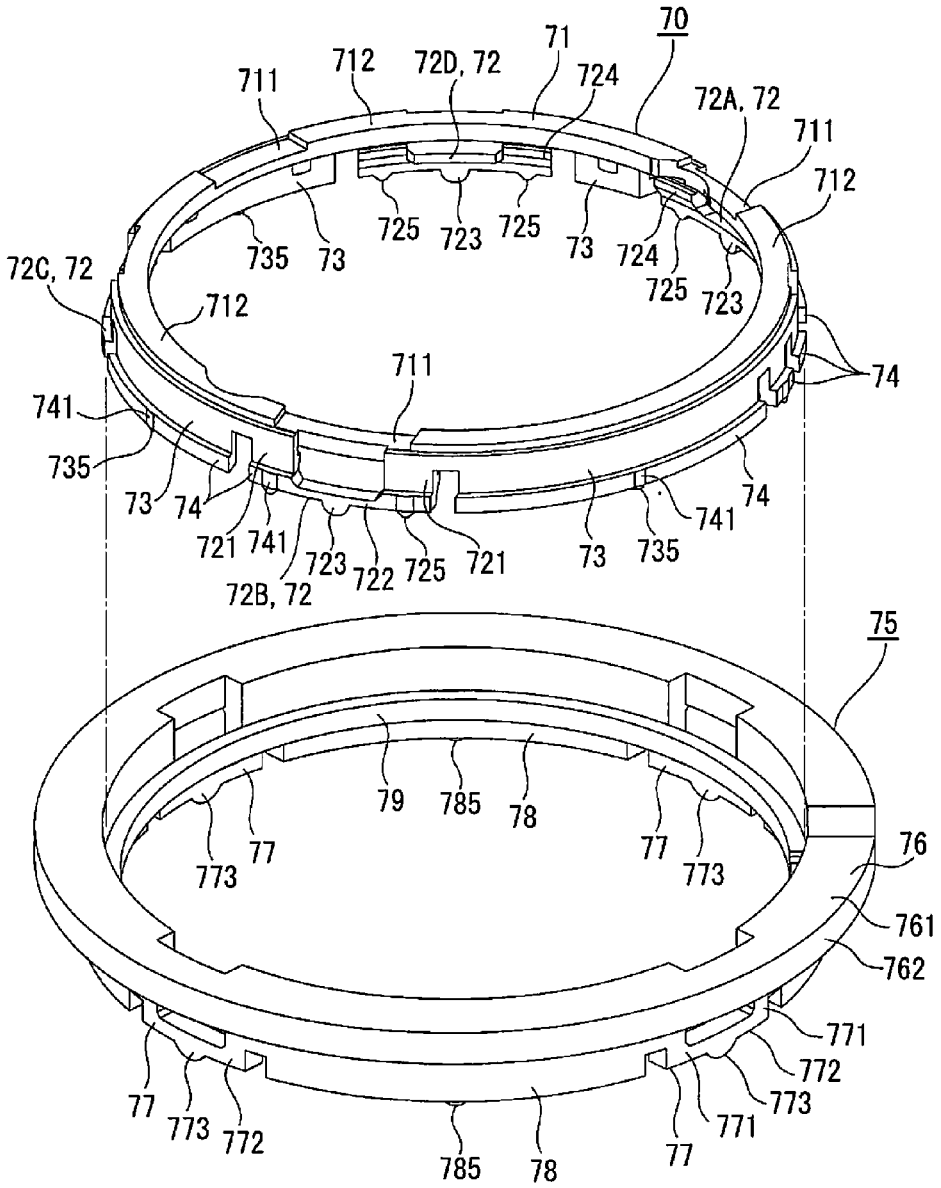
FIG. 4 is an exploded perspective view showing a dial receiving ring and a casing ring of the timepiece.
Figure 5:
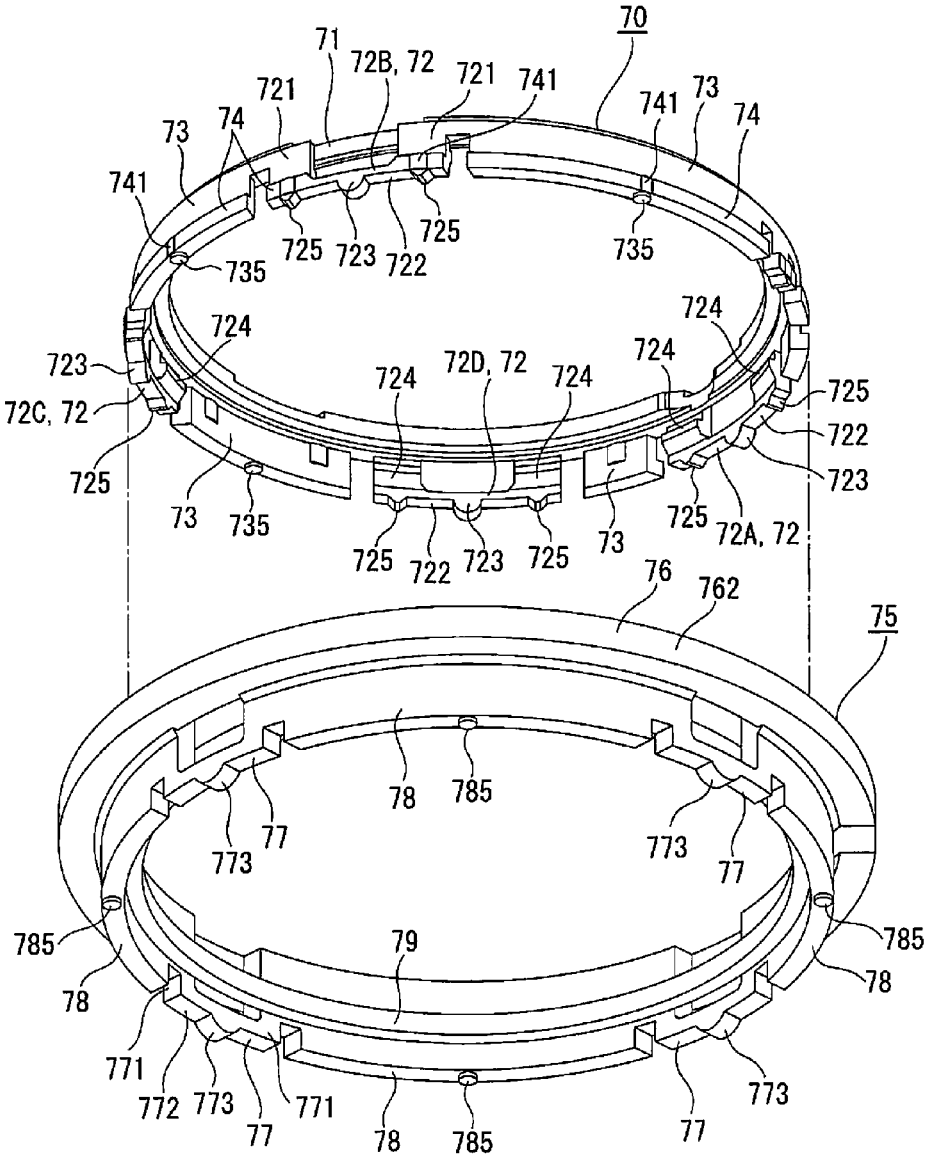
FIG. 5 is another exploded perspective view showing the dial receiving ring and the casing ring of the timepiece.

The dial receiving ring 70 is made of a polyacetal resin or any other synthetic resin and includes an upper surface section 71, which is formed in an annular shape, ring spring sections 72, which extend from the upper surface section 71 toward the casing ring 75, and sidewall sections 73, which extend from the upper surface section 71 toward the casing ring 75 and are disposed between the ring spring sections 72, as shown in FIGS. 4 and 5.

The upper surface section 71 has three recesses 711 formed therein, and the portions between the recesses 711 form ring front-surface-side contact sections 712, which protrude toward the front surface side, that is, the dial 15.

The recesses 711 are dial removal grooves used when the dial 15 is removed from a main plate of the movement 6. The ring front-surface-side contact sections 712 are sections that are in contact with the rear surface of the dial 15 and receive the dial 15.

The ring spring sections 72, the number of which is four, are formed in the circumferential direction of the upper surface section 71. Among them, two ring spring sections 72A and 72B are formed in the same position as those of two of the recesses 711. The ring spring section 72A is formed roughly in the two-o'clock in-plane position of the dial 15, and the ring spring section 72B is formed roughly in the seven-o'clock in-plane position of the dial 15.

The other two ring spring sections 72C and 72D are formed as follows: the ring spring section 72D is formed in the twelve-o'clock in-plane position of the dial 15; and the ring spring section 72C is so formed that the position thereof in the circumferential direction of the upper surface section 71 is the middle position between the ring spring section 72B and the ring spring section 72D (roughly nine-o'clock position of the dial 15).

Each of the ring spring sections 72 (72A to 72D) includes two column sections 721, which continuously extend from the upper surface section 71, and a beam section 722, which extends between the column sections 721. A push-up protrusion 723 is formed on the bottom surface of the beam section 722 in the middle position thereof. A space present above the front surface of each of the beam sections 722 allows, when force toward the upper surface section 71 acts on the push-up protrusions 723, the beam sections 722 to deflect toward the upper surface section 71, and the spring resultant force urges the dial receiving ring 70 toward the dial 15.

Hook sections 724 for holding the movement 6 are formed on the inner circumferential surfaces of the column sections 721.

Play prevention protrusions 725 and 735, which come into contact with a support section 79 of the casing ring 75, which will be described later, to prevent "play" of the dial receiving ring 70 in the height direction, are formed on the bottom surfaces (lower surfaces) of the ring spring sections 72 and the sidewall sections 73.

The play prevention protrusions 725 provided on each of the ring spring sections 72 are formed on the lower surface of the beam section 722 at two locations, and the push-up protrusion 723 is formed therebetween.

The play prevention protrusion 735 provided on each of the sidewall sections 73 is formed on the lower surface thereof roughly at the middle position in the circumferential direction.

Ring-side contact sections 74, which come into contact with the inner circumferential surface of the casing ring 75 to position the dial receiving ring 70 in the in-plane direction, are formed along the outer circumferential surface of the dial receiving ring 70. The ring-side contact sections 74 are so formed that they protrude from lower end portions of the outer circumferential surfaces of the ring spring sections 72 and the sidewall sections 73.

In the present embodiment, play prevention protrusions 741, which prevent play of the dial receiving ring 70 relative to the casing ring 75 in the in-plane direction, are formed on the outer circumferential surfaces of the ring-side contact sections 74 and in the positions corresponding to the play prevention protrusions 725 and 735.

Casing Ring

The casing ring 75 is made of a polyacetal resin or any other synthetic resin as the dial receiving ring 70 and includes a body section 76, which is formed in an annular shape, casing ring spring sections 77, which extend from the inner circumferential edge of the body section 76 toward the case back 4, and sidewall sections 78, which extend from the body section 76 toward the case back 4 and are disposed between the casing ring spring sections 77, as shown in FIGS. 4 and 5.

The upper surface of the body section 76 functions as a front-surface-side contact section 761, which comes into contact with the protruding section 111 of the barrel 11 described above. The outer circumferential surface of the body section 76 functions as a casing-ring-side contact section 762, which comes into contact with the inner circumferential surface of the barrel 11 to position the casing ring 75 in the in-plane direction.

The casing ring spring sections 77, the number of which is four, are formed in the circumferential direction of the body section 76. The positions of the four casing ring spring sections 77 formed in the circumferential direction of the body section 76 are the middle position between the twelve-o'clock and three-o'clock positions, the middle position between the three-o'clock and six-o'clock positions, the middle position between the six-o'clock and nine-o'clock positions, and the middle position between the nine-o'clock and twelve-o'clock positions of the dial 15.

Each of the casing ring spring sections 77 includes two column sections 771, which continuously extend from the body section 76, and a beam section 772, which extends between the column sections 771.

A push-up protrusion 773 is formed on the bottom surface of each of the beam sections 772. The push-up protrusion 773 is formed at the middle position of the beam section 772. A space present above the front surface of each of the beam sections 772 allows, when the push-up protrusions 773 come into contact with the case back 4 so that force toward the body section 76 acts on the beam sections 772, the beam sections 772 to deflect toward the body section 76, and the resultant spring force urges the casing ring 75 toward the dial receiving ring 70.

Play prevention protrusions 785, which come into contact with the case back 4 to prevent "play" of the casing ring 75 in the thickness direction of the timepiece, are formed on the bottom surfaces of the sidewall sections 78.

The support section 79 protrudes from the inner circumferential surface of the casing ring 75. The support section 79 is a ring-shaped protruding section continuously formed along the inner circumferential surfaces of the casing ring spring sections 77 and the sidewall sections 78. The dial receiving ring 70 described above is placed on the upper surface of the support section 79.

Dial

The dial 15 is formed of a plate made, for example, of stainless steel or any other metal material or a plastic material, and legs protruding from the bottom surface of the dial 15 are press-fit into the main plate of the movement 6, whereby the dial 15 is so attached that it is located on the front surface side of the movement 6. In this process, the rear surface of the dial 15 comes into contact with the dial receiving ring 70, whereby the height position of the dial 15 relative to the movement 6 is defined. As a result, a predetermined space is formed between the dial 15 and the main plate of the movement 6, and the date indicator 65 and the date indicator maintaining plate 66 are disposed in the space.

The dial ring 16 is disposed at the outer circumferential edge of the dial 15. The upper surface of the dial ring 16 is in contact with the lower surface of the protruding section 121 of the bezel 12. Therefore, in the present embodiment, the dial ring 16 forms a restriction section that comes into contact with the front surface of the dial 15 to restrict the position of the dial 15 in the height direction.

Structure for Positioning Casing Ring in in-Plane-Direction

Figure 6:
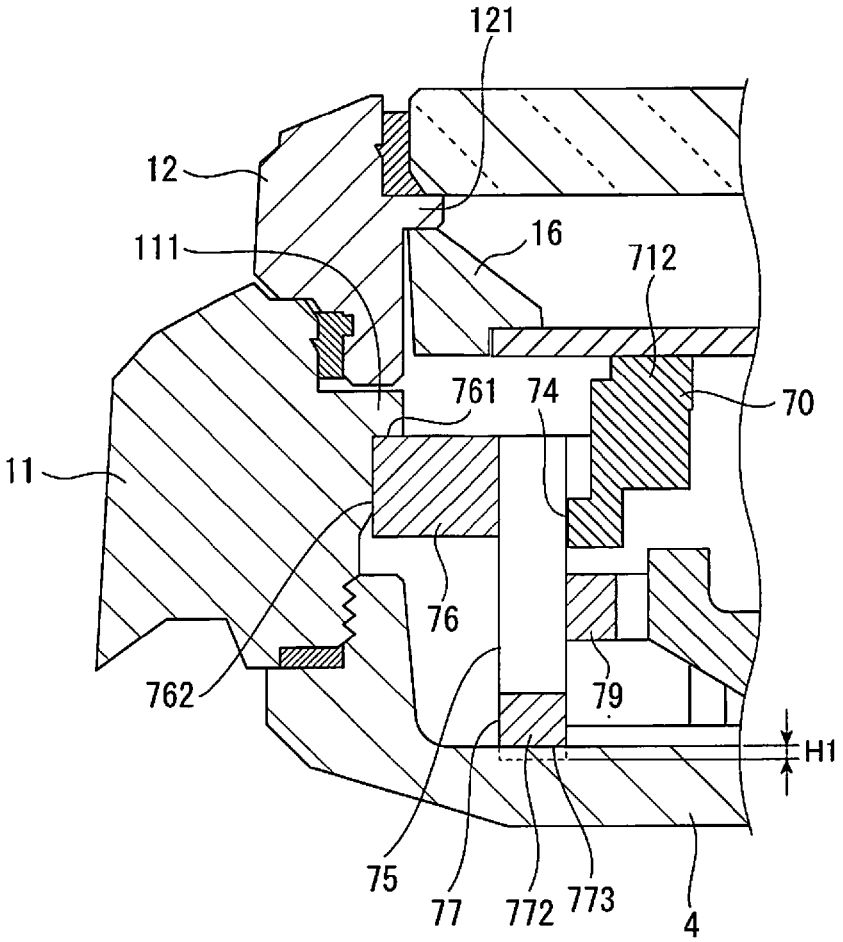
FIG. 6 is an enlarged cross-sectional view of key portions of the timepiece.

In the thus configured timepiece 1, the dial ring 16, the dial 15, the dial receiving ring 70, the casing ring 75, and the movement 6 are disposed in the case body 3. In this process, the casing-ring-side contact section 762 of the casing ring 75 comes into contact with the inner circumferential surface of the barrel 11, as shown in FIG. 6. The casing ring 75 is thus positioned in the in-plane direction.

Structure for Positioning Casing Ring in Height-Direction

When the case back 4 is screwed into the barrel 11, the casing ring 75, specifically, the front-surface-side contact section 761 of the body section 76 comes into contact with the lower surface of the protruding section 111 of the barrel 11, and the case back 4 presses the push-up protrusions 773 on the beam sections 772 of the casing ring spring sections 77 to deflect the beam sections 772. The amount of deflection of the beam sections 772 is the dimension H1 shown in FIG. 6.

The deflection of the beam sections 772 produces spring force, and reaction of the spring force urges the casing ring 75 toward the front surface side of the timepiece 1, whereby the casing ring 75 is positioned in a position where the front-surface-side contact section 761 comes into contact with the protruding section 111. That is, the casing ring 75 is sandwiched between the protruding section 111 of the barrel 11 and the case back 4.

As a result, the casing ring 75 is positioned in the height direction (timepiece thickness direction) relative to the case body 3, and the support section 79 of the casing ring 75 is also positioned in the height direction (timepiece thickness direction) relative to the case body 3.

Structure for Positioning Dial Receiving Ring and Movement in in-Plane Direction The ring-side contact sections 74 of the dial receiving ring 70 come into contact with the inner circumferential surface of the casing ring 75. The dial receiving ring 70 is thus positioned in the in-plane direction. Therefore, with reference to the inner circumferential surface of the barrel 11 of the exterior case 2, the casing ring 75 and the dial receiving ring 70 are positioned, and the movement 6, which is supported by the dial receiving ring 70, is also positioned in the in-plane direction.

Structure for Positioning Dial Receiving Ring and Movement in Height-Direction

The ring front-surface-side contact sections 712 of the dial receiving ring 70 come into contact with the dial 15. Since the dial ring 16 comes into contact with the protruding section 121 of the bezel 12, the dial 15 is positioned in the height direction relative to the case body 3.

Further, the support section 79 of the casing ring 75 presses the push-up protrusion 723 on the beam sections 722 of the dial receiving ring 70 to deflect the beam sections 772. The deflection of the beam sections 722 produces spring force, and reaction of the spring force urges the dial receiving ring 70 toward the front surface side of the timepiece 1, whereby the dial receiving ring 70 is positioned in a position where the ring front-surface-side contact section 712 comes into contact with the dial 15. That is, the dial receiving ring 70 is sandwiched between the dial 15 and the support section 79 of the casing ring 75.

As a result, the dial receiving ring 70 is positioned in the height direction (timepiece thickness direction) relative to the case body 3, and the movement 6, which is supported by the dial receiving ring 70, is also positioned in the height direction (timepiece thickness direction) relative to the case body 3.

Advantageous Effects of Present Embodiment

Since the casing ring 75 can be positioned relative to the case body 3 in the height direction and the in-plane direction, and the dial receiving ring 70 can be positioned with reference to the thus positioned casing ring 75 in the height direction and the in-plane direction, the movement 6 supported by the dial receiving ring 70 can be precisely positioned relative to the case body 3 in the height direction and the in-plane direction.

Further, when the size of the exterior case 2 of the timepiece 1 is changed, the casing ring 75 only needs to be so changed that the casing-ring-side contact section 762 has a different protruding dimension, whereby the same dial receiving ring 70 and movement 6 can be used as common parts. Therefore, when a plurality of types of timepiece 1 having different case sizes are configured, the common movement 6 and dial receiving ring 70 can be used, whereby the number of types of part can be reduced and cost reduction can therefore be achieved.

Comparison between the dial receiving ring 70 and the casing ring 75 shows that the dial receiving ring 70 is more complicated in terms of shape than the casing ring 75 because the dial receiving ring 70 has the hook sections 724 for engagement with the movement 6, the ring spring sections 72, the recesses 711 for removal of the dial 15, and other components. Since the dial receiving ring 70 having the complicated shape is configured as a common part, and the casing ring 75, which has a simpler shape than the dial receiving ring 70 and can thus be manufactured at lower cost, is prepared for each case size, the manufacturing cost can be lowered as compared with a case where the dial receiving ring 70 is manufactured for each case size.

Since the dial receiving ring 70 has a plurality of ring spring sections 72, specifically, four ring spring sections 72, the dial receiving ring 70 can be urged toward the dial 15 without inclination but in a stable manner.

Similarly, the casing ring 75 has a plurality of casing ring spring sections 77, specifically, four casing ring spring sections 77, the casing ring 75 can also be urged toward the protruding section 111 without inclination but in a stable manner.

The ring spring sections 72, each of which includes the column section 721 and the beam section 722, and the casing ring spring sections 77, each of which includes the column section 771 and the beam section 772, can be simply shaped and provide large spring force.

Further, since the push-up protrusions 723 and 773 are formed on the bottom surfaces of the beam sections 722 and 772, each of the beam sections 722 and 772 can be deflected by a large amount.

Moreover, since the hook sections 724 are formed on the column sections 721 of the ring spring sections 72, and the hook sections 724 hold the movement 6, the movement 6 can be readily attached.

The invention is not limited to the embodiment described above and can be implemented in a variety of variations within the scope of the substance of the invention.

For example, the number of ring spring sections 72 and casing ring spring sections 77 is not limited to those in the embodiment described above. In particular, three or more spring sections are preferable because the ring spring sections 72 and the casing ring spring sections 77 can be stably urged.

Further, the ring spring sections 72 and the casing ring spring sections 77 are not necessarily configured as in the embodiment described above and only need to deflect to produce spring force when they come into contact with the case back 4 and the support section 79.

The restriction section that restricts the position of the dial 15 in the height direction is not limited to the dial ring 16. For example, when the dial 15 is directly allowed to come into contact with the bezel 12 or the barrel 11, a section with which the dial 15 comes into contact is the restriction section.

The entire disclosure of Japanese Patent Application No. 2014-255170, filed Dec. 17, 2014 is expressly incorporated by reference herein.

What is claimed is:

1. A timepiece comprising:

a case that accommodates a movement and has a protruding section that protrudes from an inner circumferential surface of the case;

a case back attached to the case;

a dial receiving ring attached to the movement;

a dial disposed on a front surface side of the dial receiving ring;

a restriction section that comes into contact with a front surface of the dial to restrict a position of the dial; and a casing ring disposed around an outer circumference of the dial receiving ring, wherein the casing ring includes a casing-ring-side contact section that comes into contact with the inner circumferential surface of the case to position the casing ring in an in-plane direction, a front-surface-side contact section that comes into contact with the protruding section of the case to position the casing ring in a timepiece front surface direction, a casing ring spring section that is formed to be elastically deformable in a thickness direction of the timepiece and comes into contact with the case back, and a support section that protrudes from an inner circumferential surface of the casing ring, and the dial receiving ring includes a ring-side contact section that comes into contact with the inner circumferential surface of the casing ring to position the dial receiving ring in the in-plane direction, a ring front-surface-side contact section that comes into contact with a rear surface of the dial, and a ring spring section that is formed to be elastically deformable in the thickness direction of the timepiece and comes into contact with the support section of the casing ring.

2. The timepiece according to claim 1, wherein the ring spring section is formed of a plurality of ring spring sections provided along a circumferential direction of the dial receiving ring.

3. The timepiece according to claim 1, wherein the ring spring section includes two column sections and a beam section that extends between the column sections, a hook section that holds the movement is formed on an inner circumferential surface of each of the column sections, and a push-up protrusion that comes into contact with the support section of the casing ring is formed on a bottom surface of the beam section.

4. The timepiece according to claim 1, wherein the casing ring spring section is formed of a plurality of casing ring spring sections provided along a circumferential direction of the casing ring.

5. The timepiece according to claim 1, wherein the casing ring spring section has two column sections and a beam section that extends between the column sections, and a push-up protrusion that comes into contact with the case back is formed on a bottom surface of the beam section.

* * * * *